US009937601B2

(12) United States Patent
Chen et al.

(10) Patent No.: US 9,937,601 B2
(45) Date of Patent: Apr. 10, 2018

(54) RETAINING RING WITH SHAPED SURFACE

(71) Applicant: Applied Materials, Inc., Santa Clara, CA (US)

(72) Inventors: Hung Chih Chen, Sunnyvale, CA (US); Steven M. Zuniga, Soquel, CA (US); Charles C. Garretson, San Jose, CA (US); Douglas R. McAllister, Pleasanton, CA (US); Jian Lin, Milpitas, CA (US); Stacy Meyer, San Jose, CA (US); Sidney P. Huey, Fremont, CA (US); Jeonghoon Oh, San Jose, CA (US); Trung T. Doan, Los Gatos, CA (US); Jeffrey P. Schmidt, San Jose, CA (US); Martin S. Wohlert, San Jose, CA (US); Kerry F. Hughes, San Francisco, CA (US); James C. Wang, Saratoga, CA (US); Danny Cam Toan Lu, San Francisco, CA (US); Romain Beau De Lamenie, Menlo Park, CA (US); Venkata R. Balagani, Gilroy, CA (US); Aden Martin Allen, Oakland, CA (US); Michael Jon Fong, Mill Valley, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 14/927,193

(22) Filed: Oct. 29, 2015

(65) Prior Publication Data

US 2016/0045997 A1 Feb. 18, 2016

Related U.S. Application Data

(60) Division of application No. 14/069,207, filed on Oct. 31, 2013, now Pat. No. 9,186,773, which is a division (Continued)

(51) Int. Cl.
*B24B 37/32* (2012.01)

(52) U.S. Cl.
CPC ..... *B24B 37/32* (2013.01); *Y10T 29/49815* (2015.01)

(58) Field of Classification Search
CPC ..... B24B 37/32; B24B 37/30; B24B 37/102; B24B 37/26; B24B 41/06; B24B 41/061; Y10T 29/19815; Y10T 428/166
See application file for complete search history.

(56) References Cited

U.S. PATENT DOCUMENTS 4,270,314 A 6/1981 Cesna
5,205,082 A 4/1993 Shendon et al.
(Continued)

FOREIGN PATENT DOCUMENTS

EP 0 878 269 11/1998
EP 1 254 743 11/2002
(Continued)

OTHER PUBLICATIONS

Partial International Search Report, Application Serial No. PCT/US2004/038083, dated Mar. 31, 2005, pp. 1-2.
(Continued)

*Primary Examiner* — Dung Van Nguyen
(74) *Attorney, Agent, or Firm* — Fish & Richardson P.C.

(57) ABSTRACT

A retaining ring can be shaped by machining or lapping the bottom surface of the ring to form a shaped profile in the bottom surface. The bottom surface of the retaining ring can include flat, sloped and curved portions. The lapping can be performed using a machine that dedicated for use in lapping the bottom surface of retaining rings. During the lapping the ring can be permitted to rotate freely about an axis of the ring. The bottom surface of the retaining ring can have curved or flat portions.

13 Claims, 12 Drawing Sheets

Related U.S. Application Data of application No. 13/305,589, filed on Nov. 28, 2011, now Pat. No. 8,585,468, which is a division of application No. 13/089,174, filed on Apr. 18, 2011, now Pat. No. 8,066,551, which is a division of application No. 12/049,650, filed on Mar. 17, 2008, now Pat. No. 9,727,190, which is a continuation of application No. 10/988,211, filed on Nov. 12, 2004, now Pat. No. 7,344,434.

(60) Provisional application No. 60/520,555, filed on Nov. 13, 2003, provisional application No. 60/580,759, filed on Jun. 17, 2004, provisional application No. 60/556,569, filed on Mar. 26, 2004, provisional application No. 60/603,068, filed on Aug. 19, 2004, provisional application No. 60/580,758, filed on Jun. 17, 2004.

(56) References Cited

U.S. PATENT DOCUMENTS

| | | | |
|---|---|---|---|
| 5,536,202 | A | 7/1996 | Appel et al. |
| 5,584,751 | A | 12/1996 | Kobayashi et al. |
| 5,605,487 | A | 2/1997 | Hileman et al. |
| 5,664,988 | A | 9/1997 | Stroupe et al. |
| 5,679,065 | A | 10/1997 | Henderson |
| 5,738,574 | A | 4/1998 | Tolles et al. |
| 5,762,544 | A | 6/1998 | Zuniga et al. |
| 5,906,532 | A | 5/1999 | Nakajima et al. |
| 5,938,884 | A | 8/1999 | Hoshizaki et al. |
| 5,944,590 | A | 8/1999 | Isobe et al. |
| 6,001,007 | A | 12/1999 | Maeda et al. |
| 6,056,632 | A | 5/2000 | Mitchel et al. |
| 6,093,089 | A | 7/2000 | Chen et al. |
| 6,113,479 | A | 9/2000 | Sinclair et al. |
| 6,116,992 | A | 9/2000 | Prince |
| 6,143,127 | A | 11/2000 | Perlov et al. |
| 6,183,354 | B1 | 2/2001 | Zuniga et al. |
| 6,224,472 | B1 | 5/2001 | Lai et al. |
| 6,251,215 | B1 | 6/2001 | Zuniga et al. |
| 6,386,962 | B1 | 5/2002 | Gotkis et al. |
| 6,390,904 | B1 | 5/2002 | Gleason et al. |
| 6,506,105 | B1 | 1/2003 | Kajiwara et al. |
| 6,602,116 | B1 | 8/2003 | Prince |
| 6,676,497 | B1 | 1/2004 | Chen et al. |
| 6,699,107 | B2 | 3/2004 | Stoeckgen et al. |
| 6,716,086 | B1 | 4/2004 | Tobin |
| 6,872,130 | B1 | 3/2005 | Zuniga |
| 6,896,602 | B2 | 5/2005 | Oshita et al. |
| 7,094,133 | B2 | 8/2006 | Masunaga et al. |
| 7,344,434 | B2 | 3/2008 | Chen et al. |
| 7,927,190 | B2 | 4/2011 | Chen et al. |
| 8,066,551 | B2 | 11/2011 | Chen et al. |
| 8,585,468 | B2 | 11/2013 | Chen et al. |
| 2001/0053665 | A1 | 12/2001 | Lee et al. |
| 2002/0049026 | A1 | 4/2002 | Katagiri et al. |
| 2002/0173242 | A1 | 11/2002 | Wang et al. |
| 2003/0029841 | A1 | 2/2003 | Moon et al. |
| 2012/0071067 | A1 | 3/2012 | Chen et al. |
| 2014/0053981 | A1 | 2/2014 | Chen et al. |

FOREIGN PATENT DOCUMENTS

| | | |
|---|---|---|
| TW | 412059 | 11/2000 |
| TW | 529977 | 5/2003 |
| TW | 537108 | 6/2003 |
| TW | 540445 | 7/2003 |
| TW | 549184 | 8/2003 |
| TW | 567931 | 12/2003 |
| TW | 261318 | 4/2005 |
| WO | WO 00/54933 | 9/2000 |
| WO | WO 00/78504 | 12/2000 |
| WO | WO 03/015147 | 2/2003 |
| WO | WO 2005/049274 | 6/2005 |

OTHER PUBLICATIONS

International Search Report and Written Opinion of the International Search Authority, Application Serial No. PCT/US2004/038083, dated Sep. 16, 2005, 19 pp.

Taiwanese Application Serial No. 093121055, "Method for Assembling a Carrier Head for Chemical Mechanical Polishing", Jul. 14, 2004, 31 pages.

Ali et al, "Investigating the Effect of Secondary Platen Pressure on Post-Chemical-Mechanical Planarization Cleaning", *Microcontamination*, pp. 45-50, Oct. 1994.

Kolenkow et al, "Chemical-Mechanical Wafer Polishing and Planarization in Batch Systems", *Solid State Technology*, pp. 112-114, Jun. 1992.

Runnels, "Modeling the Effect of Polish Pad Deformation on Water Surface Stress Distributions During Chemical-Mechanical Polishing", Electrochem. Soc. Annual Meeting, 1993, pp. 110-121.

Yuan et al, "A Novel Wafer Carrier Ring Design Minimizes Edge Over-Polishing Effects for Chemical Mechanical Polishing", VMIC conference, Jun. 27-29, 1995 ISMIC 104/95/525, pp. 525-527, 1995.

International Preliminary Report on Patentability issued for PCT/US2004/038083 dated May 26, 2006, 14 pages.

European Search Report for Application Serial No. 10153712.4, dated Apr. 10, 2012.

Taiwan Office Action for Application No. 93134996, dated Jan. 17, 2011, 4 pages.

Japanese Office Action for Application No. 2006-539965, dated Jul. 20, 2010, 5 pages.

Japanese Office Action for Application No. 2006-539965, dated Feb. 24, 2011, 2 pages.

Japanese Office Action for Application No. 2006-539965, dated Oct. 27, 2011, 3 pages.

Japanese Office Action for Application No. 2006-539965, dated May 17, 2012, 3 pages.

Examination report dated Nov. 30, 2011 for corresponding application KR 2006-7011644.

Office Action dated Aug. 22, 2012 for Korean Application No. 10-2006-7011644 (4 pages).

Office Action in European Application No. 04801058.1, dated Jan. 17, 2007, 5 pages.

Office Action in European Application No. 04801058.1, dated Feb. 11, 2008, 6 pages.

Search Report in TW Application No. 100125328, date of research Mar. 17, 2014, 2 pages.

RETAINING RING WITH SHAPED SURFACE

CROSS-REFERENCE TO RELATED APPLICATIONS

This application is a divisional of U.S. application Ser. No. 14/069,207, filed Oct. 31, 2013, which is a divisional application of U.S. application Ser. No. 13/305,589, filed Nov. 28, 2011, which is a divisional application of U.S. application Ser. No. 13/089,174, filed Apr. 18, 2011, which is a divisional of U.S. application Ser. No. 12/049,650, filed Mar. 17, 2008, which is a continuation of U.S. application Ser. No. 10/988,211, filed on Nov. 12, 2004, which claims the benefit of priority of U.S. Provisional Application No. 60/520,555, filed Nov. 13, 2003, U.S. Provisional Application No. 60/580,759, filed Jun. 17, 2004, U.S. Provisional Application No. 60/556,569, filed Mar. 26, 2004, U.S. Provisional Application No. 60/603,068, filed Aug. 19, 2004 and U.S. Provisional Application No. 60/580,758, filed Jun. 17, 2004.

BACKGROUND

This invention relates to a retaining ring for use in chemical mechanical polishing.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. The substrate is held below the carrier head with a retaining ring. A polishing liquid, such as a slurry including abrasive particles, is supplied to the surface of the polishing pad.

SUMMARY

In one aspect, the invention is directed to a retaining ring that has not been use in device substrate polishing. The retaining ring has a generally annular body having a top surface, an inner diameter surface, an outer diameter surface and a bottom surface. The bottom surface has a target surface characteristic that substantially matches an equilibrium surface characteristic that would result from breaking-in the retaining ring with the device substrate polishing.

In one aspect, the invention is directed to a retaining ring for a chemical mechanical polisher having a generally annular body having a top surface, an inner diameter surface, an outer diameter surface and a bottom surface, wherein the bottom surface has a convex shape and wherein a difference in height across the bottom surface is between 0.001 mm and 0.05 mm.

In another aspect, the invention is directed to a retaining ring for a chemical mechanical polisher having a generally annular body having a top surface, an inner diameter surface, an outer diameter surface and a bottom surface, wherein the bottom surface includes a generally horizontal portion adjacent the inner diameter surface and a sloped portion adjacent the outer diameter surface.

In another aspect, the invention is directed to a retaining ring for a chemical mechanical polisher having a generally annular body having a top surface, an inner diameter surface, an outer diameter surface and a bottom surface, wherein the bottom surface includes a generally horizontal portion and rounded corners adjacent the inner diameter surface and the outer diameter surface.

In another aspect, the invention is directed to a retaining ring for a chemical mechanical polisher having a generally annular body having a top surface, an inner diameter surface, an outer diameter surface and a bottom surface, wherein the bottom surface includes a convex portion adjacent the inner diameter surface and a concave portion adjacent the outer diameter surface.

In another aspect, the invention is directed to a retaining ring for a chemical mechanical polisher having a substantially annular body having a top surface, an inner diameter surface adjacent to the top surface, an outer diameter surface adjacent to the top surface, and a bottom surface, where the bottom surface has a sloped first portion adjacent to the inner diameter surface and a sloped second portion adjacent to the outer diameter surface and the first portion is not planar with the second portion.

In another aspect, the invention is directed to a retaining ring for use in chemical mechanical polishing having a substantially annular body having a top surface, an inner diameter surface adjacent to the top surface, an outer diameter surface adjacent to the top surface, and a bottom surface, wherein the bottom surface has at least one frustoconical surface between the inner diameter to the outer diameter, and wherein a difference in height across the bottom surface is between 0.002 mm and 0.02 mm.

In another aspect, the invention is directed to a retaining ring having an annular body having a bottom surface with a shaped radial profile formed by lapping the bottom surface using a first machine dedicated for use in lapping the bottom surface of retaining rings.

In another aspect, the invention is directed to a retaining ring having an annular body having a bottom surface, an inner surface, an outer surface and a top surface configured for attachment to a carrier head, wherein the retaining ring includes a first portion and a second portion having different surface roughness.

In another aspect, the invention is directed to a retaining ring having an annular body having a bottom surface, an inner surface, an outer surface and a top surface configured for attachment to a carrier head, an inner edge between the inner surface and the bottom surface having a first radius of curvature, and an outer edge between the outer surface and the bottom surface having a second radius of curvature that is different from the first radius of curvature.

In another aspect, the invention is directed to a retaining ring having an annular body having a bottom surface, an inner surface, an outer surface and a top surface configured for attachment to a carrier head, wherein the bottom surface of the retaining ring includes polyamide-imide.

In yet another aspect, the invention is also directed to a lapping machine. The machine has a rotating platen, a plurality of restraining arms associated with the platen, each restraining arm operable to keep an object from moving along the path of the platen's rotation, while allowing the object to rotate about one or more points in the object. The machine also has an adaptor operable to couple a source of pneumatic pressure and a source of vacuum to at least one of the objects such that pneumatic pressure and vacuum can be applied to the object simultaneously.

In yet another aspect the invention is directed to an apparatus for forming a predetermined profile on a bottom surface of a retaining ring. The apparatus has a lapping table and a retaining ring holder. At least one of the lapping table and retaining ring holder is configured to apply a pressure differential across a width of the retaining ring.

In still another aspect, the invention is directed to a method of forming a retaining ring that includes removing material from a bottom surface of an annular retaining ring to provide a target surface characteristic. The removal is performed using a first machine dedicated for use in removing material from a bottom surface of retaining rings, and the target surface characteristic substantially matches an equilibrium surface characteristic that would result from breaking-in the retaining ring on a second machine used for polishing of device substrates.

In still another aspect, the invention is directed to a method of forming a surface profile on a bottom surface of a retaining ring. A bottom surface of an annular retaining ring is held in contact with a generally planar polishing surface. Non-rotational motion is created between the bottom surface and the polishing surface to wear the bottom surface until the bottom surface reaches an equilibrium geometry.

In still another aspect, the invention is direct to a method of forming a retaining ring. A retaining ring with an inner diameter surface, an outer diameter surface, a top surface and a bottom surface is formed. The bottom surface is lapped to provide a predetermined non-planar profile.

In still another aspect, the invention is directed to a method of forming a retaining ring. A retaining ring with an inner diameter surface, an outer diameter surface, a top surface and a bottom surface is formed. The bottom surface is machined to provide a predetermined non-planar profile.

In still another aspect, the invention is directed to a method of forming a retaining ring. A retaining ring with an inner diameter surface, an outer diameter surface, a top surface and a bottom surface is formed. The bottom surface is shaped to have two or more annular regions where at least one of the regions is not parallel to the top surface.

In still another aspect, the invention is directed to a method of forming a retaining ring. A retaining ring with an inner diameter surface, an outer diameter surface, a top surface and a bottom surface is formed. The bottom surface is shaped to provide at least one frustoconical surface from the inner diameter to the outer diameter, wherein a difference in height across the bottom surface is between 0.002 mm and 0.02 mm.

In still another aspect, the invention is direct to a method for shaping a retaining ring. A retaining ring having a bottom surface is provided. The bottom surface is lapped to form a shaped radial profile in the bottom surface, the lapping being performed using a first machine dedicated for use in lapping the bottom surface of retaining rings.

In still another aspect, the invention is directed to a method for shaping a retaining ring. A retaining ring having a bottom surface is provided. The bottom surface is lapped to form a shaped radial profile in the bottom surface, wherein during the lapping the ring is permitted to rotate freely about an axis of the ring.

In even another aspect, the inventions is directed to a method of using a retaining ring. A bottom surface of an annular retaining ring is lapped to provide a target surface characteristic, the lapping being performed using a first machine dedicated for use in lapping the bottom surface of retaining rings. The retaining ring is secured on a carrier head. A plurality of device substrates are polished with a second machine using the carrier head, wherein the target surface characteristic substantially matches an equilibrium surface characteristic that would result from breaking-in the retaining ring on the second machine.

Implementations of the invention may provide none, one or more of the following advantages. A radial profile of a bottom surface of a retaining ring may be shaped to improve polishing uniformity at a substrate edge. For example, a retaining ring with a thinner inner diameter may provide slower edge polishing, whereas a retaining ring with a thicker inner diameter can provide faster edge polishing. The radial profile of the retaining ring may be shaped for a particular process to reduce or eliminate any changes in the radial profile of the bottom surface as the ring wears during polishing. A retaining ring that does not change profile as it wears may provide improved substrate-to-substrate uniformity in the edge polishing rate. The retaining ring may be shaped to a desired radial profile to reduce or obviate any break-in process, thereby reducing machine downtime and cost of ownership. Because the break-in period may be reduced or eliminated, the retaining ring can be formed of a highly wear resistant material which would normally require lengthier break-in periods.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A retaining ring 100 is a generally an annular ring that can be secured to a carrier head of a CMP apparatus. A suitable CMP apparatus is described in U.S. Pat. No. 5,738,574 and a suitable carrier head is described in U.S. Pat. No. 6,251,215, the entire disclosures of which are incorporated herein by reference. The retaining ring 100 fits into a loadcup for positioning, centering, and holding the substrate at a transfer station of the CMP apparatus. A suitable loadcup is described in U.S. patent application Ser. No. 09/414,907, filed Oct. 8, 1999, the entire disclosure of which is incorporated by reference.

Figure 1:
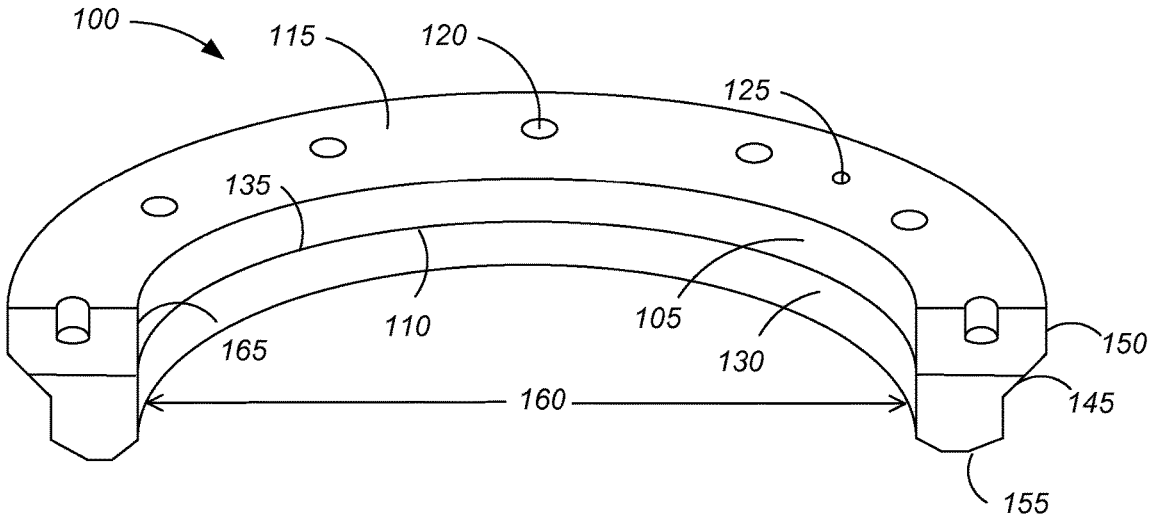
FIG. 1 is a schematic perspective view, partially cross-sectional, of a retaining ring according to the present invention.
Figure 2:
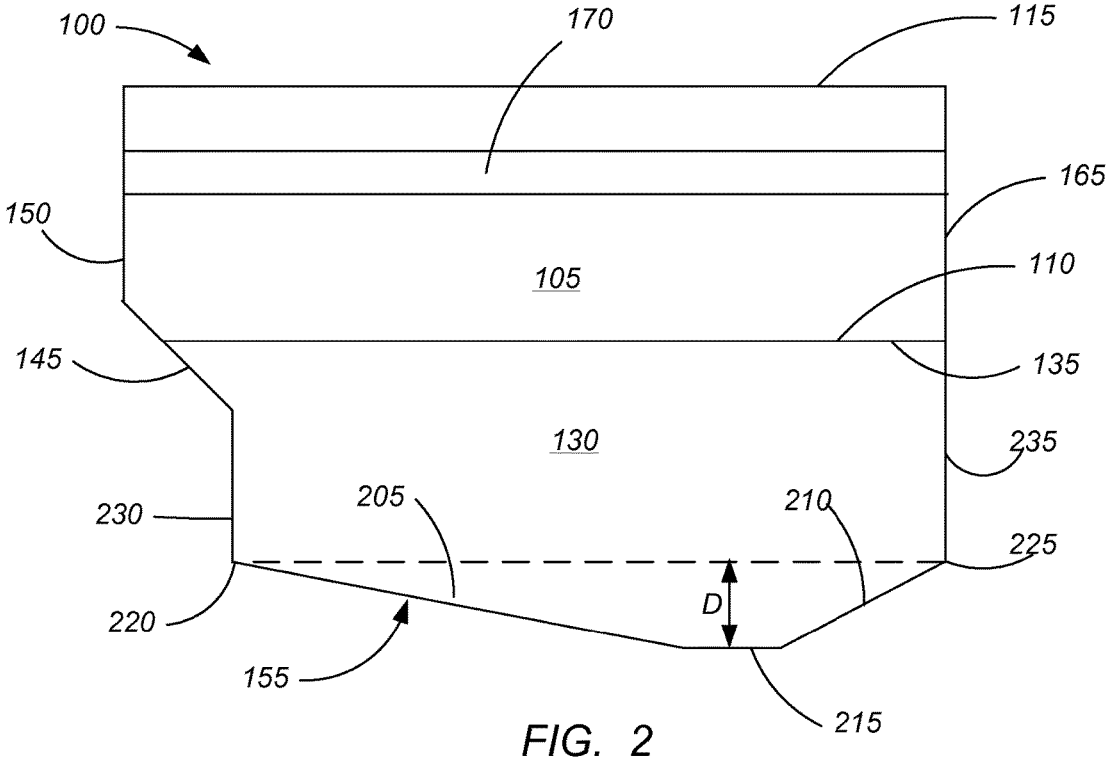
FIG. 2 is a schematic enlarged cross-sectional view of the retaining ring of FIG. 1.

As shown in FIGS. 1 and 2, the upper portion 105 of the retaining ring 100 has a flat bottom surface 110, a cylindrical inner surface 165, a cylindrical outer surface 150, and a top surface 115 that is generally parallel to the bottom surface 110. The top surface includes holes 120 to receive mechanical fasteners, such as bolts, screws, or other hardware (such as screw sheaths or inserts), for securing the retaining ring 100 and carrier head together (not shown). Generally, there are eighteen holes, however there can be a different number of holes. Additionally, one or more alignment apertures 125 can be located in the top surface 115 of the upper portion 105. If the retaining ring 100 has an alignment aperture 125, the carrier head can have a corresponding pin that mates with the alignment aperture 125 when the carrier head and retaining ring 100 are properly aligned.

The upper portion 105 of the retaining ring 100 can include one or more passages, e.g., four drain holes spaced at equal angular intervals around the retaining ring, to provide pressure equalization, for injection of cleaning fluid, or expulsion of waste. These drain holes extend horizontally through the upper portion 105 from the inner surface 165 to the outer surface 150. Alternatively, the drain holes can be tilted, e.g., higher at the inner diameter surface than at the outer diameter surface, or the retaining ring can be manufactured without drain holes.

The upper portion 105 can be formed from a rigid or high tensile modulus material, such as a metal, ceramic or hard plastic. Suitable metals for forming the upper portion include stainless steel, molybdenum, titanium or aluminum. In addition, a composite material, such as a composite ceramic, can be used.

The second piece of the retaining ring 100, the lower portion 130, can be formed from a material that is chemically inert to the CMP process and may be softer than the material of the upper portion 105. The material of the lower portion 130 should be sufficiently compressible or elastic that contact of the substrate edge against the retaining ring 100 does not cause the substrate to chip or crack. However, the lower portion 130 should not be so flowable as to extrude into the substrate receiving recess 160 when the carrier head puts downward pressure on the retaining ring 100. The hardness of the lower portion 130 can be between 75 and 100 Shore D, e.g., between 80 and 95 Shore D. The lower portion 130 should also be durable and have high wear resistance, although it is acceptable for the lower portion 130 to wear away. For example, the lower portion 130 can be made of a plastic, such as polyphenylene sulfide (PPS), polyethylene terephthalate (PET), polyetheretherketone (PEEK), carbon filled PEEK, polyetherketoneketone (PEKK), polybutylene terephthalate (PBT), polytetrafluoroethylene (PTFE), polybenzimidazole (PBI), polyetherimide (PEI), or a composite material.

The lower portion may also have a flat top surface 135, a cylindrical inner surface 235, a cylindrical outer surface 230, respectively, and a bottom surface 155. Unlike the top portion 105, the lower portion's bottom surface 155 has a non-flat geometry or profile. In certain implementations, the shaped radial profile of bottom surface 155 can include curved, frustoconical, flat and/or stepped sections. A retaining ring with a shaped radial profile includes at least one non-planar portion on the bottom surface 155. Typically, it is advantageous for the radial profile of the bottom surface 155 of the retaining ring 100 to substantially match an equilibrium profile (discussed below) of the bottom surface 155 for the process in which the retaining ring 100 will be used. The equilibrium profile can be determined, for example, by experimentation (e.g., examining a worn retaining ring) or by software modeling.

The lower portion 130 and the upper portion 105 are connected at their top 135 and bottom 110 surfaces, respectively, to form the retaining ring 100. When the upper portion 105 and lower portion 130 are aligned and mated, the outer diameter surface of the retaining ring 100 can have a unitary tapered surface 145 (e.g., wider at the top than at the bottom) between the two cylindrical surfaces 150 and 230. The two parts can be joined using an adhesive, mechanical fasteners such as screws, or a press-fit configuration. The adhesive can be an epoxy, e.g., two-part slow-curing epoxy, such as Magnobond-6375™, available from Magnolia Plastics of Chamblee, Ga.

An enlarged view of one embodiment of the retaining ring is shown in FIG. 2. The bottom surface 155 retaining ring has a profile with a region 210 having a downward slope from the inner diameter 165 and a region 205 having a downward slope from the outer diameter 150. The lower edge 220 of the outer surface 230 can be above, below or at the same height as the lower edge 225 of the inner surface 235. The regions 205 and 210 can form substantially frustoconical surfaces, i.e., in a radial cross-section the profile of the bottom surface 155 will be substantially linear across each region. The sloped surfaces extend to a region 215 that is substantially parallel to the top surface of the lower portion. Thus, the bottom surface 155 can include exactly three regions with substantially linear radial profiles.

Figure 3:
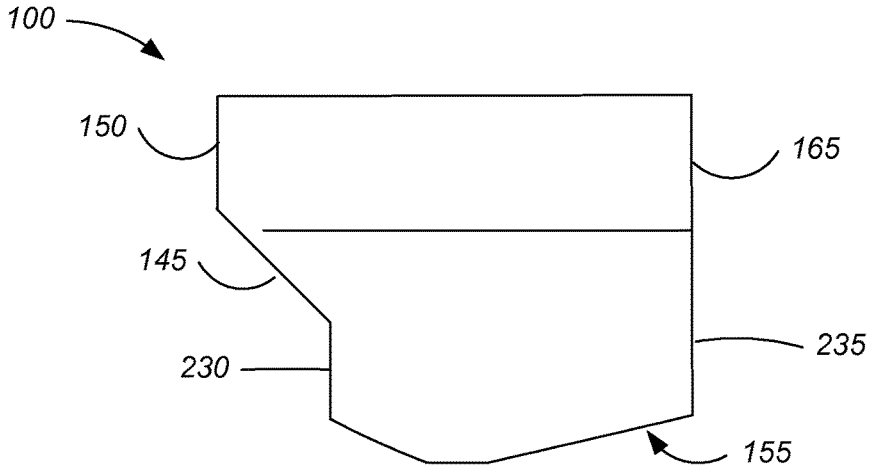
FIG. 3-12 are schematic cross-sectional views showing a alternative implementations of the retaining ring.

The bottommost portion of the bottom surface 155, e.g., the thickest portion, such as the planar region 215, can be closer to the inner diameter 165 than the outer diameter 150. Alternatively, as shown in FIG. 3, the bottommost portion can be closer to the outer diameter 150 than the inner diameter 165.

Figure 4A:
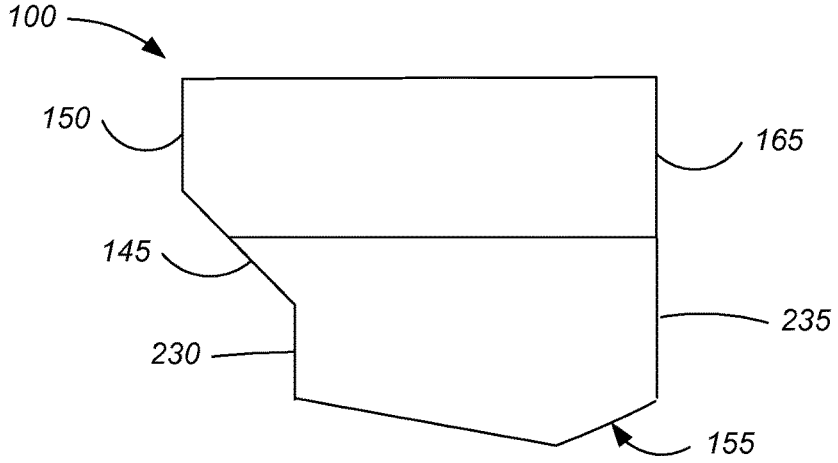
Figure 4B:
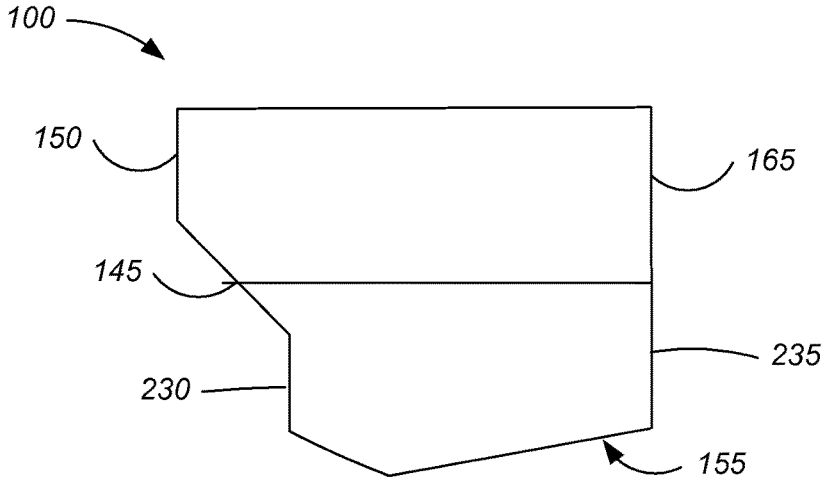
Figure 5A:
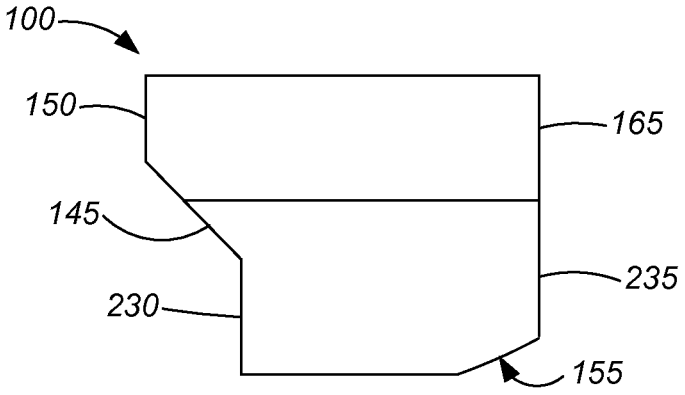
Figure 5B:
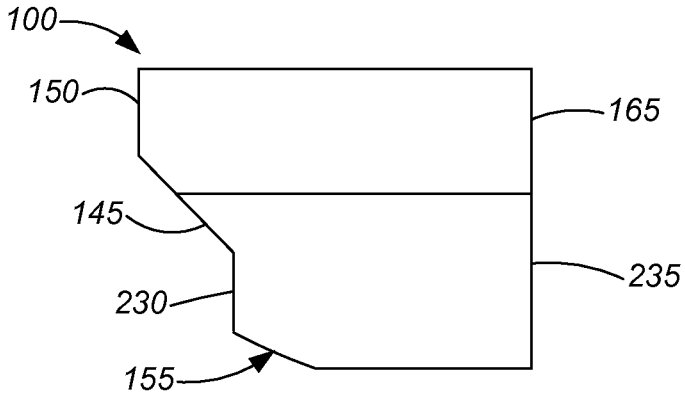

As shown in FIGS. 4A and 4B, other implementations have a bottom surface 155 with exactly two distinct sloped, frustoconical regions. Alternatively, as shown in FIGS. 5A and 5B, one of the regions can be frustoconically sloped, and the other region can be substantially parallel to the top surface. Thus, the bottom surface 155 of the retaining ring can include exactly two regions with substantially linear radial profiles.

Hypothetically, any number of regions can be machined on the bottom surface. However, because the difference D between the thinnest and thickest part of the lower part's profile typically vary less than by 0.02 mm, three regions are generally the maximum number of regions machined. Frustoconical regions can approximate the curved shape of the bottom surface of one of the retaining rings. Alternatively, the bottom surface of the ring can be formed with a curved surface or a curved portion.

Figure 6:
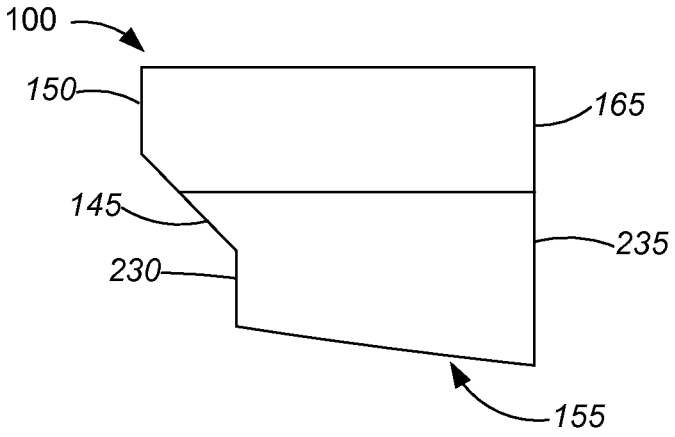

Referring to FIG. 6, in yet another implementation, the bottom surface 155 of the retaining ring 100 is formed to be a single frustoconical region. In this implementation, the region can be sloped downward from the outside in, i.e., the lower edge 220 of the outer surface 230 is above the lower edge 225 of the inner surface 235.

For the implementations shown in FIGS. 2-6, the height difference D across the bottom surface, and thus (assuming that the top surface 135 is a planar surface) the thickness difference between the thickest and thinnest parts of the lower portion's profile, can be between 0.001 mm and 0.05 mm, e.g., between 0.002 mm and 0.02 mm. For example, the difference D can be generally around 0.01 mm.

Figure 7:
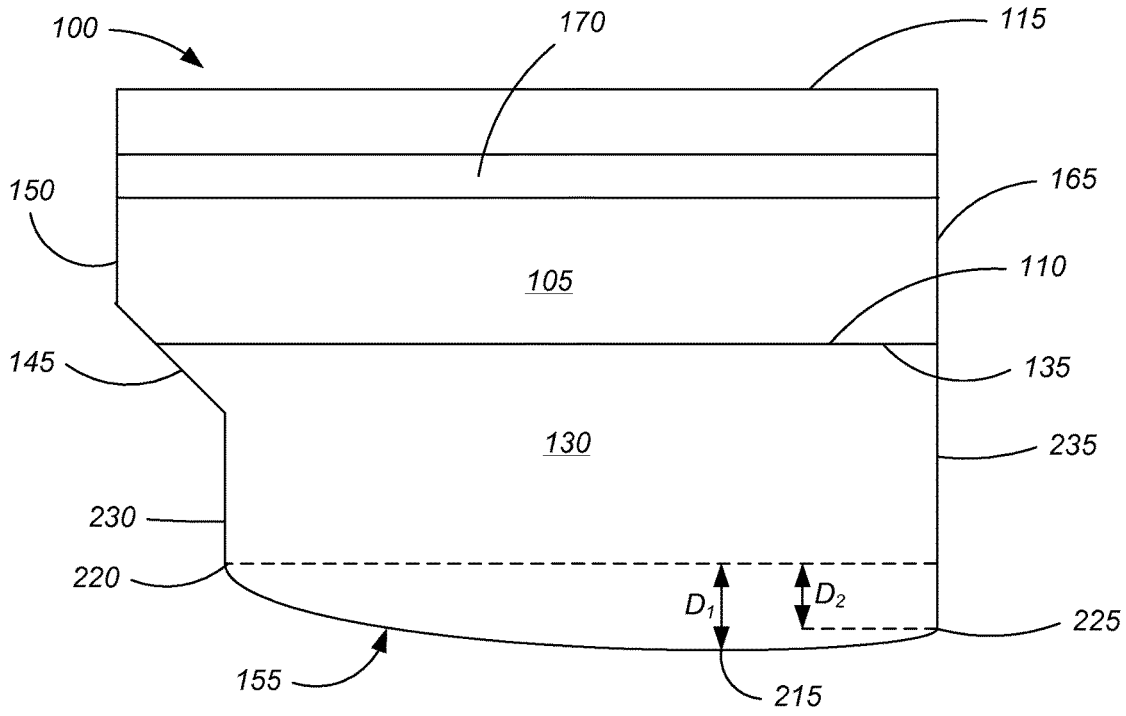

Referring to FIG. 7, the bottom surface 155 of the retaining ring 100 has a convex or shaped radial profile. Thus, the profile of the bottom surface 155 in the radial cross-section is curved. The shape of the radial profile of the bottom surface 155 can vary, depending on the process parameters of the process in which retaining ring 100 will be used. The lower edge 220 of the outer surface 230 can be above, below or at the same height as the lower edge 225 of the inner surface 235.

The bottommost portion of the bottom surface 155, such as the portion at a point 215, can be closer to the inner surface 235 than the outer surface 230, as shown in FIG. 7. The lowest point of the bottom surface 155 can be between 0.001 mm and 0.05 mm, e.g., between 0.002 mm and 0.02 mm, from the lower edge 225 of the inner surface 235. Alternatively, the bottommost portion can be closer to the outer surface 230 than the inner surface 235. Typically, it is advantageous for the bottommost portions (e.g., point 215) of every radial cross-section of the ring to be coplanar. That is, the retaining ring 100 would ideally form a continuous circle of contact when laid on a perfectly flat surface. Furthermore, isocontours (e.g., points on the bottom surface 155 having the same distance from the perfectly flat surface) of the bottom surface 155 of retaining ring 100 would ideally form circles. All radial profiles of the bottom surface 155 of the retaining ring 100 ideally would be uniform. The bottommost portions of every radial cross-section of a physical realization of the retaining ring 100 may vary slightly from being perfectly coplanar. For example, in some implementations, the bottommost portions on different radial cross-sections can vary by ±0.004 mm from being coplanar.

The height difference $D_1$ across the bottom surface, and thus (assuming that the top surface 135 is a planar surface) the thickness difference between the thickest and thinnest parts of the lower portion's profile, can be between 0.001 mm and 0.05 mm, e.g., between 0.002 mm and 0.01 mm. For example, the difference $D_1$ can be generally around 0.0076 mm. (The Figures described herein are exaggerated and not to scale in order to show the radial profile more clearly; the curvature of the profile might not be apparent on visual inspection).

The lower edge 220 of the outer surface 230 can be above the lower edge 225 of the inner surface 235. The lowest point of the bottom surface 155 can be between 0.001 mm and 0.05 mm, e.g., between 0.002 mm and 0.01 mm, from the lower edge 225 of the inner surface 235. For example, $D_1$-$D_2$ can be generally around 0.0025 mm.

Figure 8:
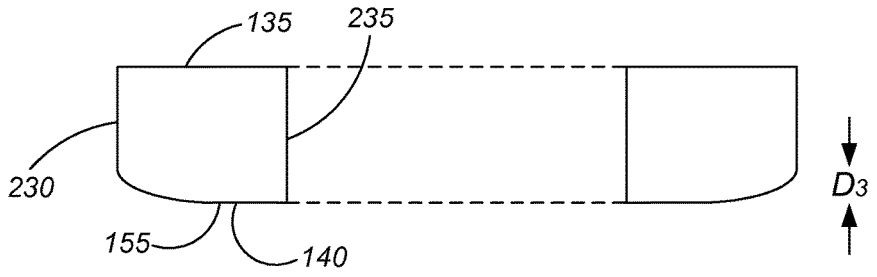

Referring to FIG. 8, in another implementation, the bottom surface 155 of the retaining ring can have a continuous curved shape that has a nearly horizontal portion 140 adjacent the inner surface 112 and can have the greatest slope adjacent the outer diameter surface 230. Similar to FIG. 7, in this implementation the resulting bottom surface 155 is sloped downward from the outside in, i.e., the lower edge of the outer surface 230 is above the lower edge of the inner surface 235.

Figure 9:
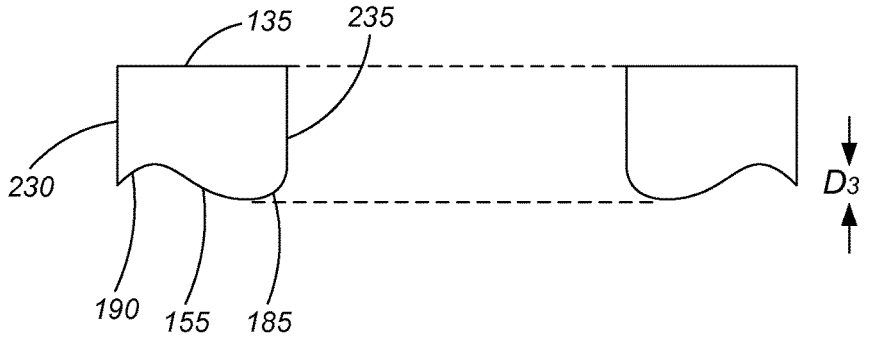

Referring to FIG. 9, in yet another implementation, the bottom surface 155 can have a "sinusoidal" shape, with a convex portion 185 adjacent the inner surface 235 and a concave portion 190 adjacent the outer surface 230. Alternatively, the concave portion 190 can be adjacent the inner surface 235, and the convex portion 185 can be adjacent the outer surface 230.

Figure 10:
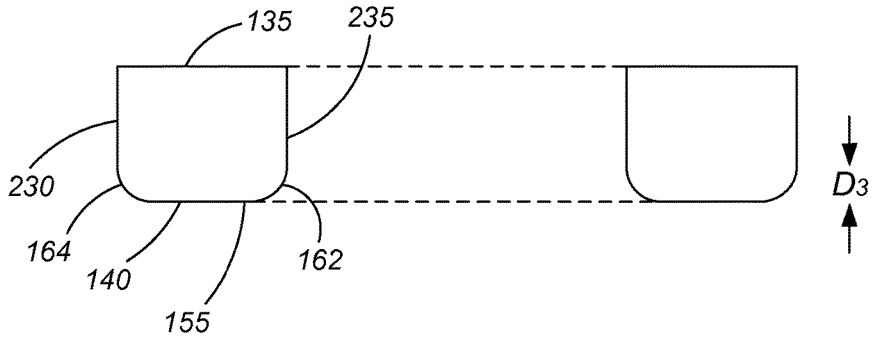

Referring to FIG. 10, in another implementation, the bottom surface 155 can have a generally horizontal portion 140, and rounded edges 162 and 164 at the inner and outer diameter surface 235 and 230. The rounded inner and outer edges 162 and 164 can have the same radial curvature.

Figure 11:
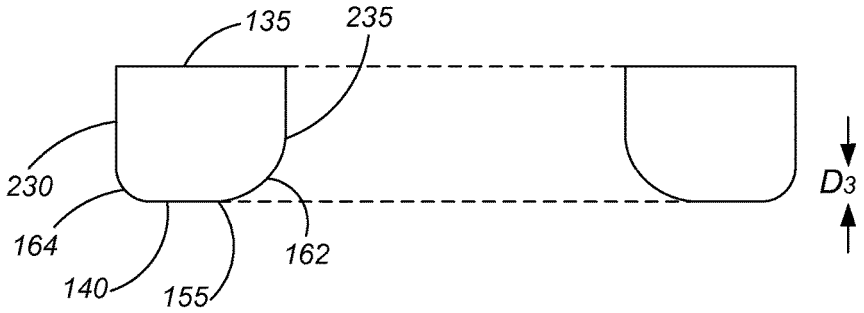
Figure 12:
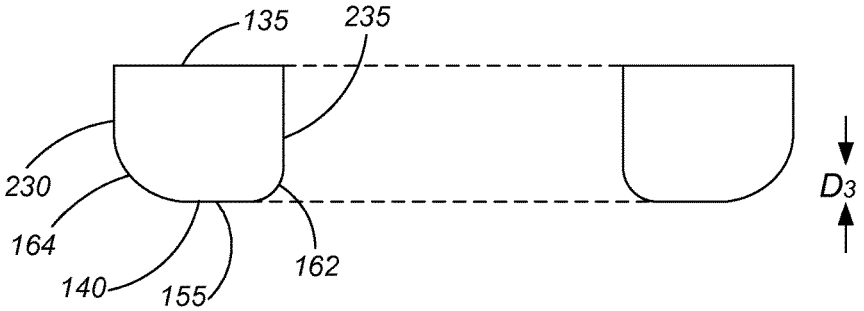

Referring to FIGS. 11 and 12, in further implementations, the rounded edges 162 and 164 have different curvatures. For example, the radius of the inner edge 162 can be larger (as shown in FIG. 11) or smaller (as shown in FIG. 12) than the radius of the outer edge 164.

The height difference $D_3$ across the bottom surface, and thus (assuming that the top surface of the lower portion is a planar surface) the thickness difference between the thickest and thinnest parts of the lower portion's profile, can be between 0.001 mm and 0.05 mm, e.g., between 0.01 mm and 0.03 mm. For example, the difference $D_3$ can be between 0.0025 mm, 0.0076 mm or generally around 0.018 mm.

Although the discussion above has focused on the geometry of the bottom surface, the retaining ring can be formed with other surface characteristics that substantially match the equilibrium characteristics that would result from polishing. The bottom surface 155 can have a very smooth surface finish. For example, the bottom surface of the retaining ring may be formed with a target roughness average (RA) of bottom surface 155 can be less than 4 micro inch, less than 2 micro inch or 1 micro inch or less. In general, the retaining ring can have a surface roughness better than that achievable with conventional machining techniques. In addition, the retaining ring can be formed with regions of different roughness. For example, the bottom surface 155 of the retaining ring can have regions, e.g., concentric annular regions, of different surface roughness. In another implantation, the bottom surface 155 has a surface roughness less than that of the sides 230 and 235 (i.e., the bottom surface is smoother). These concepts could be applicable to any of the retaining rings described above, or even to retaining rings with an entirely flat bottom surface.

The bottom surface 155 of the lower portion 130 can also include unillustrated channels or grooves, e.g., twelve or eighteen channels, to permit a polishing fluid, such as slurry, which can include abrasives or be abrasive-free, to flow underneath the retaining ring 100 to the substrate in the substrate receiving recess 160. The channels can be straight or curved, can have a uniform width or be flared so as to be wider at the outer diameter of the retaining ring, and can have a uniform depth or be deeper at the inner surface 235 than at the outer surface 230. Each channel can have a width of about 0.030 to 1.0 inches, such as 0.125 inches, and may have a depth of 0.1 to 0.3 inches. The channels can be distributed at equal angular intervals around the retaining ring 100. The channels are typically oriented at an angle $\alpha$, such as 45°, relative to a radial segment extending through the center of the retaining ring 100, but other angles of orientation, such as between 30° and 60°, are possible.

Having discussed various implementations of the retaining ring above, the use and method of manufacturing the retaining ring will be discussed below. In normal operation of the CMP apparatus, a robotic arm moves a 300 mm substrate from cassette storage to a transfer station. At the transfer station, the substrate is centered in the loadcup. The carrier head moves into place above the loadcup. Once the carrier head and loadcup are generally aligned with one another, the carrier head is lowered into position to collect the substrate. Specifically, the carrier head is lowered so that the bottom of the retaining ring's outer surface engages the inner surface of the loadcup.

Once the substrate has been loaded into the carrier head, the carrier head lifts away to disengage from the loadcup. The carrier head can move from the transfer station to each of the polishing stations on the CMP apparatus. During CMP polishing, the carrier head applies pressure to the substrate and holds the substrate against the polishing pad. During the polishing sequence, the substrate is located within the receiving recess 160 of the retaining ring 100, which prevents the substrate from escaping. Once polishing is completed, the carrier head returns to a position over the loadcup and lowers so that the retaining ring 100 is brought into and re-engages the loadcup. The substrate is released from the carrier head, and subsequently moved to the next step of the polishing sequence.

The bottom surface 155 of the retaining ring 100 contacts the polishing pad during the substrate polishing process. The profile of the retaining ring 100 affects the rate of substrate edge polishing. Typically, when the retaining ring is thinner at the inner diameter, the edge of the substrate is polished more slowly than when the retaining ring is flat across the bottom. Conversely, if the retaining ring is thicker at the inner diameter, the edge is polished faster.

A conventional "ideal" retaining ring is typically formed with the bottom surface having a generally flat radial profile. Thus, if a conventional "ideal" retaining ring were laid on a perfectly flat surface, all points of the conventional retaining ring's bottom surface ideally would touch the flat surface. While the bottom surface of an actual conventional retaining ring may have some degree of roughness or unevenness, the average radial profile of the ring can be determined by averaging multiple radial cross-sections of the ring, and this average radial profile will be generally flat. During polishing, the polishing pad wears away the bottom surface 155 of the retaining ring 100. Typically, wearing does not occur at an even rate radially across the bottom surface 155. This uneven wearing causes the bottom surface 155 to take on a non-flat geometry. For example, the portion of the bottom surface 155 that is closest to the inner diameter 165 of the retaining ring 100 can wear away faster than the portion of the bottom surface 155 of the retaining ring 100 that is closest to the outer diameter of the retaining ring 100. The wearing of the retaining ring 100 eventually comes to an equilibrium, such that the bottom surface of the retaining ring 100 retains the substantially same geometry as the ring wears until the process or polishing conditions change.

The equilibrium geometry of the retaining ring profile depends on the polishing process conditions, such as slurry composition, polishing pad composition, retaining ring down force, and platen and carrier head rotation rate. Other factors include the polishing pad stiffness, the retaining ring stiffness, the condition of the polishing pad surface, the polishing down force and the polishing velocity.

Polishing at the substrate edge will drift until the retaining ring 100 reaches equilibrium. To reduce substrate to substrate or across substrate polishing variation, the retaining ring can be "broken in" before being used in the polishing process. One way of breaking in a retaining ring is by simulating substrate polishing, using the same type of polishing apparatus as the rings will be use for polishing of device matters e.g., by pressing the retaining ring against a polishing pad so that the ring wears until it reaches the equilibrium geometry. However, a disadvantage of "break-in" is that it requires use of the polishing apparatus. As a result, the break-in process is down-time of the polishing apparatus during which no polishing can be performed, increasing cost of ownership.

Instead of the retaining ring with a polishing apparatus, the desired retaining ring profile can be shaped, e.g., created by machining the bottom surface of the ring, before the retaining ring is used in a polishing machine so that the bottom surface has the equilibrium that generally would result from a desired set of polishing conditions. Although a retaining ring can have a curved surface typically the machining process will create "flat" regions (i.e., regions with linear radial profiles, such as planar or frustoconical surfaces) which together approximate the geometry of a broken in retaining ring. The desired profile geometry is generally determined by using a retaining ring with the same process conditions that will be selected when the retaining ring is used to polish substrates until the retaining ring reaches its equilibrium geometry. This equilibrium geometry is repeatable given the same process conditions. Thus, this retaining ring profile can be a model for the machined retaining rings.

Figure 13:
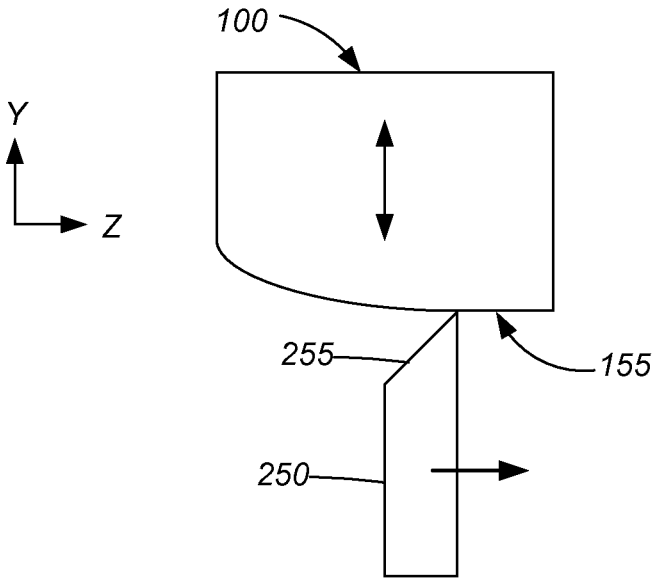
FIG. 13 is a schematic side view of a lathe.

Referring to FIG. 13, the machining can be performed with a lathe, e.g., the retaining ring 100 can be rotated about its axis while its bottom surface is brought into contact with a blade 250. The blade 250 has a cutting edge 255 that is substantially smaller than the surface of the retaining ring being machined. As the retaining ring rotates, the blade 250 sweeps along the z-axis (either the blade or the retaining ring can move to provide this sweep) while the relative position of the blade along the y-axis is adjusted in a predetermined pattern (again, either the blade or the retaining ring can move to provide this positioning), thereby machining out a predetermined contour on the bottom surface of the retaining ring. Machining can be Computer Numerical Controlled (CNC) machining.

Figure 14:
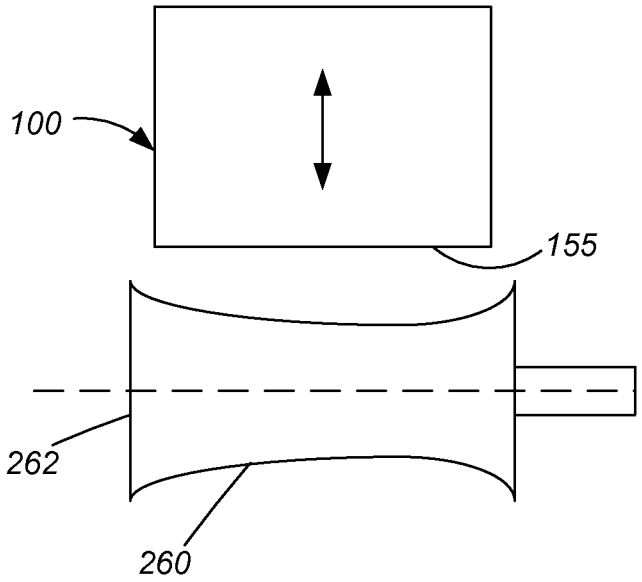
FIG. 14 is a schematic side view of a machining device.

Referring to FIG. 14, the machining can also be performed using a pre-shaped custom cutter, e.g., the retaining ring 100 can contact a cutting surface 260 that is wider than the bottom surface of the retaining ring and has a predetermined contour. In particular, the cutting surface 260 can be formed on the cylindrical surface of a drum 262, e.g., with a series of serrations or with a roughened surface such as diamond grit. The drum 262 rotates about its axis while the retaining ring 100 rotates about its axis, and the bottoms surface 155 of the retaining ring 100 is moved into contact with the cutting surface 260. Thus, the bottom surface 155 of the retaining ring is ground into a predetermined contour that is the complement of the contour on the cutting surface 260.

Alternatively, the machining can be performed using a modified lapping process to simulate the CMP environment. A variety of lapping machines can be used, such as machines that use rotational, dual rotational, vibratory, random vibratory, or orbiting motion. It can be noted that the lapping machine need not use the same type of relative motion as the polishing machine. In short, by lapping the bottom surface of the retaining ring under conditions that simulate the polishing environment, the bottom surface of the retaining ring will be worn into the equilibrium geometry. This equilibrium geometry is repeatable given the same process conditions. This lapping can be performed separately from the polishing apparatus and using less expensive machinery, thus reducing the costs of the break-in procedure.

A CMP machine typically includes many components that are not necessary for lapping table 300. For example, a CMP machine typically includes an endpoint detection system, a wafer load/unload station, one or more washing stations, motors to rotate and a carousel to move the carrier heads, and a robotic wafer transfer system. Typically, only one carrier head is used at a time per platen in a CMP machine, and the number of carrier heads can be one greater than the number of platens.

Figure 15:
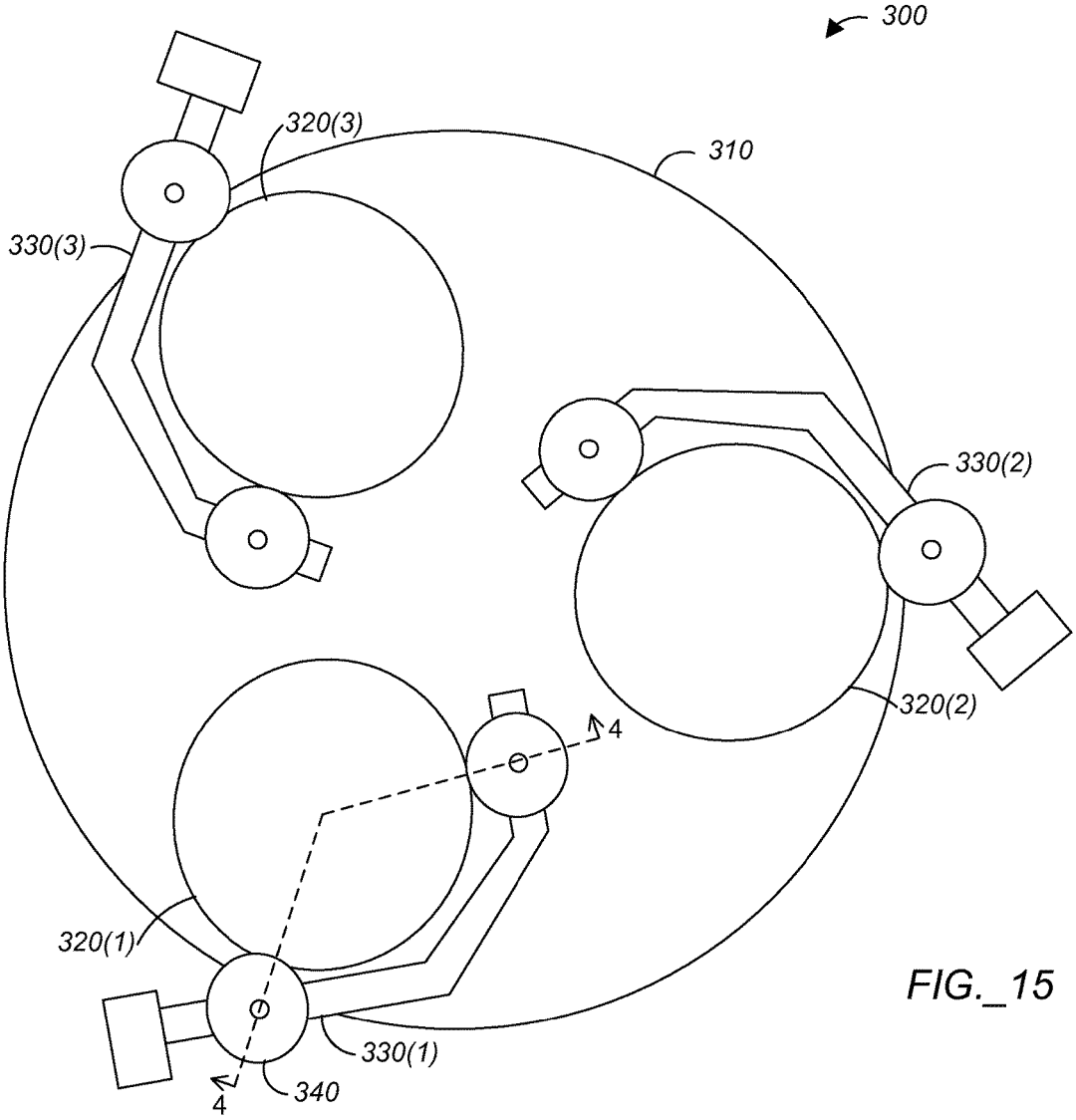
FIGS. 15-25 are schematic views of lapping devices and components.
Figure 16:
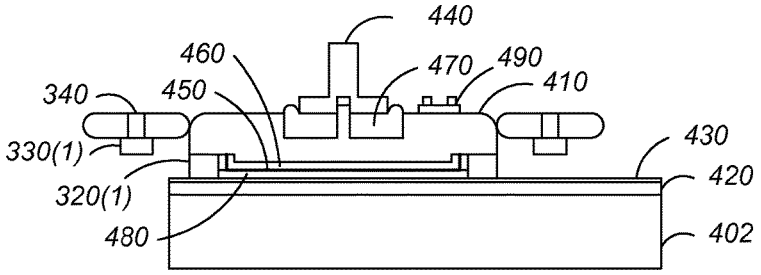

For example, a retaining ring 100 with a shaped radial profile in the bottom surface 155 can be formed using a lapping apparatus such as the lapping apparatus 300 in FIGS. 15 and 16. The lapping apparatus 300 includes a rotating platen 402 (e.g., a stainless steel, aluminum, or cast iron platen rotating at, for example, 60-70 rpm), to which a lapping pad 420 suitable for lapping plastics (e.g., a Rodel® IC1000 or IC1010 pad with or without a backing pad) can be affixed. Lapping fluid 430 (e.g., Cabot Microelectronics Semi-Sperse® 12) can be supplied to the lapping pad 420, for example, using a slurry pump (not shown) (e.g., with a flow rate of 95-130 mL/min.). The lapping pad 420 can be a conventional polyurethane pad, a felt pad, a compliant foam pad, or a metallic pad, and the lapping fluid 430 supplied to the lapping pad 420 can be deionized water, an abrasive-free solution, or an abrasive (such as a powdered silica) slurry.

Multiple retaining rings 320(1)-320(3) (e.g., retaining ring 100) can be lapped at once, and the lapping apparatus 300 can include multiple arms 330(1)-330(3) that hold the retaining rings 320(1)-320(3) during lapping. The arms 330(1)-330(3) can have one or more wheels 340 attached that allow retaining rings 320(1)-320(3) to rotate freely during lapping. Alternatively, the retaining rings 320(1)-320(3) could be forced to rotate during lapping, but allowing the retaining rings 320(1)-320(3) to rotate freely simplifies the design and operation of the lapping apparatus 300. The amount time required to shape the retaining ring's profile (e.g., 20-60 minutes) typically depends on the desired profile and surface finish for the retaining ring, the material of the retaining ring, and the lapping process parameters.

The retaining rings 320(1)-320(3) can be secured to CMP carrier heads (e.g., carrier head 410, which can be, for example, a Contour or Profiler carrier head manufactured by Applied Materials) during the lapping process. The carrier heads can be coupled to a source of pneumatic pressure and vacuum (not shown) using an adaptor 490. The adaptor 490 can be designed so that pneumatic pressure and vacuum can be applied to the carrier head 410 simultaneously. Pneumatic pressure can be applied to the carrier heads (e.g., to shaft 440) to force the retaining rings 320(1)-320(3) against the platen 402 or lapping pad 420 during lapping. The pressure applied can be varied during lapping to control the speed of lapping and the shape of the radial profile of the bottom surfaces (e.g., bottom surface 155) of the retaining rings 320(1)-320(3). In one implementation, weights can be used on the carrier heads (e.g., instead of, or combined with, pneumatic pressure) to force the retaining rings 320(1)-320(3) against the platen 402 or lapping pad 420 during lapping.

In addition to the force applied to the carrier head, pneumatic pressure can be applied to one or more chambers 470 between the shaft 440 and the retaining ring 320(1), which lifts the shaft 440 away from the ring (though the shaft 440 and ring remain coupled) and allows the self-gimbaling effect of the carrier head to operate. The amount of pressure applied in the chamber 470 (e.g., 0.5 psi) can be balanced with the amount of force applied to the shaft 440 (e.g., 60-100 lbs.) so that the shaft 440 and the retaining ring 320(1) remain properly aligned.

The retaining rings 320(1)-320(3) can be lapped while holding substrates or without substrates. If the carrier head includes a membrane 450 with a substrate receiving surface, vacuum can be applied to a chamber 460 behind the membrane 450 to draw the membrane 450 away from the lapping pad 420 and prevent the membrane 450 from contacting the lapping pad 420 or the platen during lapping. This can help prevent membrane breakage when the retaining rings 320(1)-320(3) do not hold substrates.

The process parameters used during lapping (e.g., retaining ring down force, platen rotation rate, lapping pad composition, and slurry composition) can be matched to the process parameters of a CMP process in which the retaining rings 320(1)-320(3) will be used after the retaining rings 320(1)-320(3) are lapped. Substrates such as a dummy substrate 480 (e.g., a quartz or silicon wafer) can be placed inside the retaining rings 320(1)-320(3) during lapping to protect the carrier head membrane 450 and to simulate more closely the process parameters of the CMP process. For example, the membrane 450 can push the dummy substrate 480 against the lapping pad 420 to simulate the CMP process. In one implementation, one of the retaining rings 320(1)-320(3) is replaced with a conditioner (e.g., a diamond disc) capable of abrading the polishing pad 420 to restore a rough surface texture to the pad.

Figure 17:
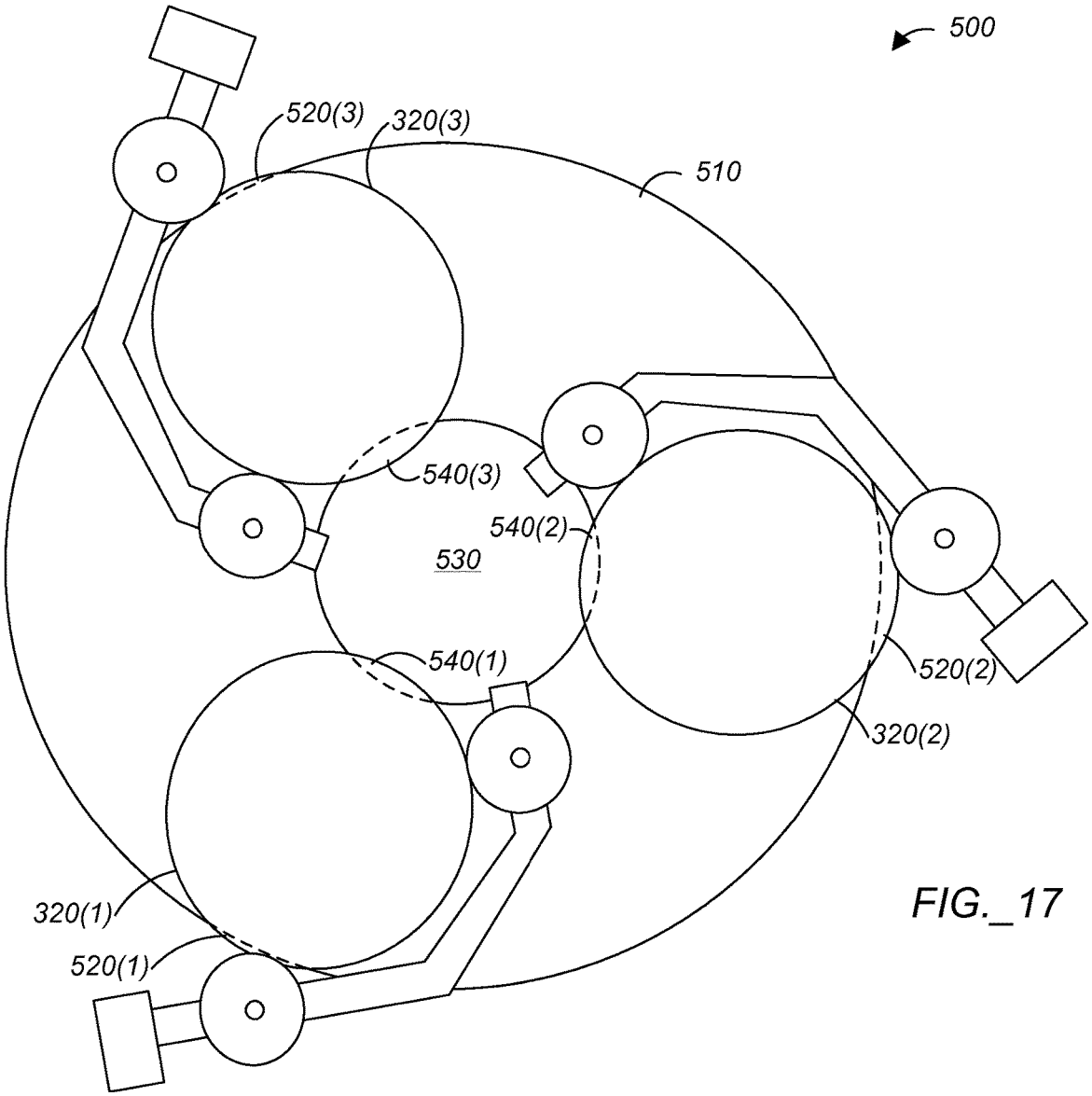

Referring to FIG. 17, a lapping table 500 is an alternative implementation of the lapping apparatus 300. The retaining rings 320(1)-320(3) are positioned on a platen 510 such that at least a small part (overhangs 520(1)-520(3)) of each ring extends beyond the outside edge of the platen 510. The platen 510 can also have a hole 530 in the center so that at least a small part (overhangs 540(1)-540(3)) of each ring also extends beyond the edge of the hole 530. Allowing the retaining rings 320(1)-320(3) to extend beyond the edges of the platen 510 can help to avoid a situation in which a path is worn in the lapping pad 420 (FIG. 4) with an unworn portion of the lapping pad 420 outside of the worn path. If an unworn section of the lapping pad 420 abuts a worn section, an edge effect can occur when lapping retaining rings 320(1)-320(3) that can reduce the uniformity of the lapping. The lapping pad 420 can extend over the hole 530 (e.g., the lapping pad 420 can be circular rather than annular). This implementation should have the same advantages in that the portion of the lapping pad 420 over the hole 530 should not cause an edge effect because it is not supported by platen 510, but no slurry recovery system is required in the hole 530.

Figure 18:
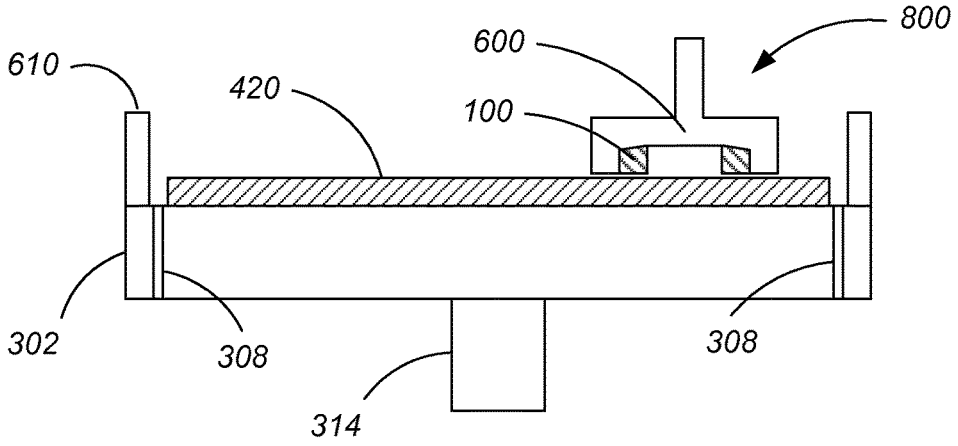

Referring to FIG. 18, in another implementation, a lapping apparatus 300 can include a table, such as a randomly rotatable or vibrational lapping table 302. The lapping table 302 can be supported by a drive shaft 314 that is connected to a motor to rotate or vibrate the lapping table 302. The lapping apparatus 300 also includes one or more, e.g., three, covers 600 to hold the retaining ring 100 against the lapping pad 420 to undergo the machining process. The covers 600 can be distributed at equal angular intervals about the center of the lapping table 302. One or more drainage channels 308 can be formed through the lapping table 302 to carry away used lapping fluid.

The edge of the lapping table 302 can support a cylindrical retaining wall 610. The retaining wall 610 prevents the lapping fluid from flowing over the side of the lapping table 302, and captures the retaining ring 100 in the event that a retaining ring escapes from beneath one of the covers 600. Alternatively, the lapping fluid may flow off the edge of lapping table to be captured and recirculated or to be discarded.

Figure 19:
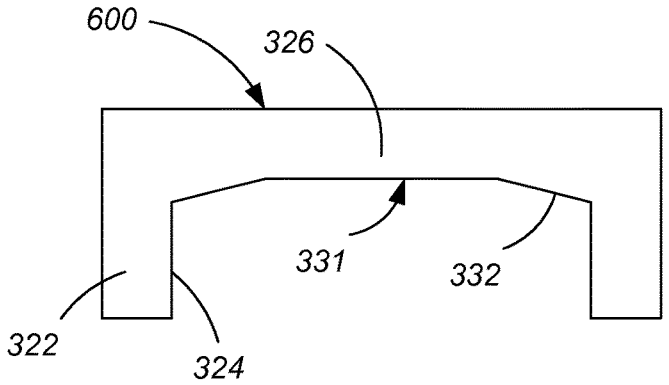

Referring to FIG. 19, the cover 600 includes a main body 326 and a retaining flange 322 projecting from the main body 326. The retaining flange 322 has a cylindrical inner surface 324 with an inner diameter equal to the outer diameter of the retaining ring 100 to be machined. The retaining flange 322 surrounds a lower surface 331 of the cover body 326. An outer circumferential portion 332 of the lower surface 331 adjacent the retaining flange 322 is sloped relative to the plane of the lapping pad, e.g., sloped downwardly from the inside outward.

The cover 600 can provide three functions. First, the cover 600 protects the outer surfaces of the retaining ring 100 (i.e., the surfaces other than the bottom surface 155) from wear or damage during the lapping process. Second, the cover 600 applies a load to the retaining ring which can be about the same as the load which will be applied during the polishing process. Third, the sloped portion 332 of the cover 600 applies a differential load across the retaining ring width, so that the retaining ring 100 resulting from the machining process will have a taper on its bottom surface, e.g., sloped downwardly from its outside inward as shown in FIG. 19. Consequently, the retaining ring 100 can be pre-tapered into a shape that matches the equilibrium geometry of the ring for the polishing process, thereby reducing the need for a retaining ring break-in process at the polishing machine and improving substrate-to-substrate uniformity in the edge polishing rate.

Figure 20:
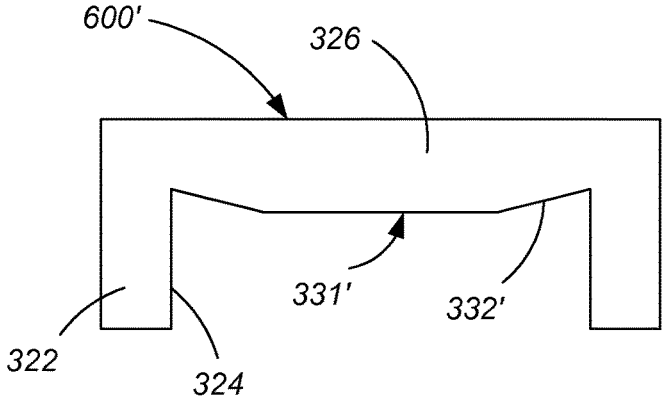

Referring to FIG. 20, in another implementation, the outer circumferential portion 332' of the lower surface 331' of the cover can be sloped upwardly from its inside outward relative to the plane of the lapping pad. The retaining ring 100 resulting from the machining process will also have a taper on its bottom surface, e.g., sloped upwardly from its outside inward.

Figure 21:
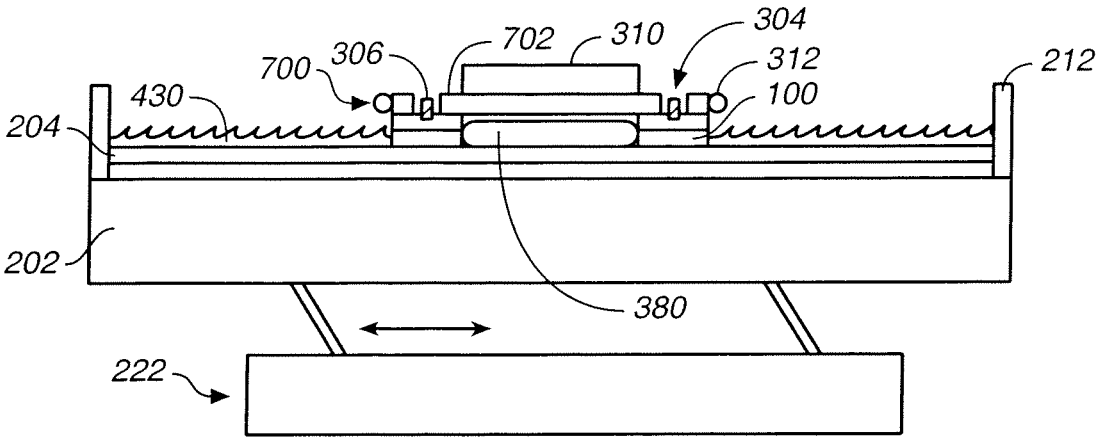

Referring to FIG. 21, in yet another implementation, a retaining ring holder 700 holds and presses the retaining ring 100 against the polishing pad 204. The retaining ring holder 700 can be a simple disk-shaped body 702 having through-holes 304 or other appropriate structures around its periphery for mechanically securing the retaining ring to the holder 700. For example, screws 306 can fit through the through-holes 304 into the receiving holes in the top surface of the retaining ring to affix the retaining ring 100 to the holder 700. Optionally, a dummy substrate 380 can be placed beneath the retaining ring holder inside the inner diameter of the retaining ring.

A weight 310 can be placed or secured on top of the disk-shaped body 702 so that the downward load on the retaining ring during the break-in process generally matches the load applied during the substrate polishing operation. Alternatively, a dampening spring can be positioned to press the holder 700 and retaining ring onto the pad 204. The dampening spring may help prevent the holder 700 from "jumping" off the pad 204 during vibrational movement.

One or more resilient bumpers 312 can be secured to the sides of the retaining ring holder 700. For example, the bumper 312 can be an O-ring that surrounds the retaining ring holder 700.

The table 202 is supported by a drive mechanism 222 that drives the table in random vibrational movement. The retaining ring holder 700 is free floating on the table 202, and thus will move in a random vibratory path across the table. The bumper 312 causes the retaining ring holder 700 to bounce off the retaining wall 212, thereby contributing to the random motion of the holder and preventing damage to the holder or retaining ring from the retaining wall.

Figure 22:
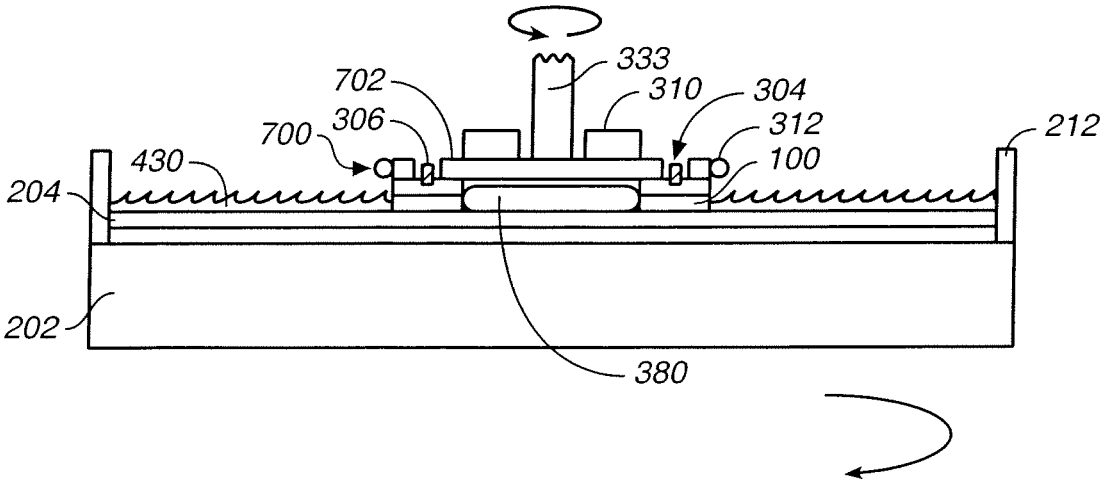

In another implementation, illustrated in FIG. 22, the retaining ring holder 700 is connected to a drive shaft 333 that maintains the holder 700 in a laterally fixed position. The drive shaft 333 can be rotatable so as to controllably rotate the holder 700 and the retaining ring 100, or the holder 700 may be free to rotate under the applied forces. In this implementation, the table 202 is supported by a drive mechanism that drives the table in elliptical motion, e.g., along an orbital path. In addition, the retaining ring holder 700 does not need the resilient bumper.

Figure 23:
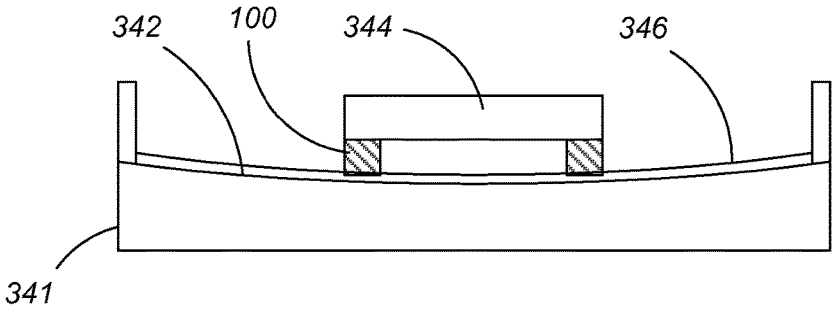

Referring to FIG. 23, as another alternative, the retaining ring can be formed using a shaped polishing or lapping table 341. For example, the upper surface 342 of the table 341 can be slightly convex so as to apply more pressure to the outer edges of the retaining ring and thus induce a taper. In this implementation, a retaining ring carrier 344 presses the retaining ring 100 the polishing table 341 as the table vibrates or oscillates. Optionally, a polishing or lapping pad 346 can cover the polishing table.

Figure 24:
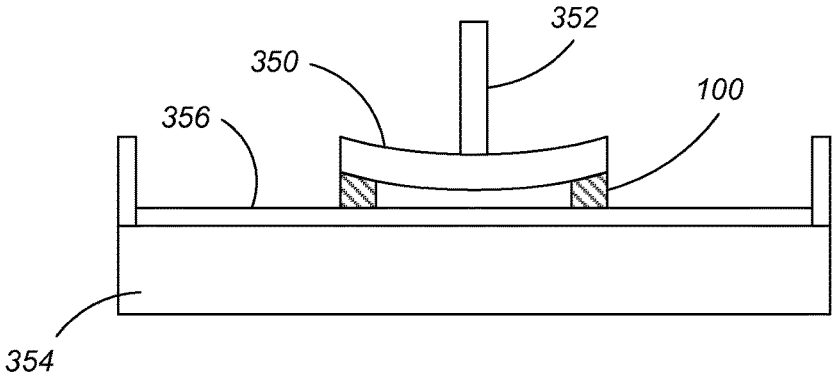

Referring to FIG. 24, as yet another alternative, the retaining ring can be formed using a bendable or flexible mounting carrier 350. For example, an unillustrated loading system can apply a downward pressure to a rotatable drive shaft 352. This pressure causes the center of the retaining ring carrier 350 to bow toward the platen 354, thereby applying increased pressure to the inner edges of the retaining ring 100. The platen 354 can be stationary, vibrating or rotating. Optionally, a polishing or lapping pad 356 may cover the polishing table.

Figure 25:
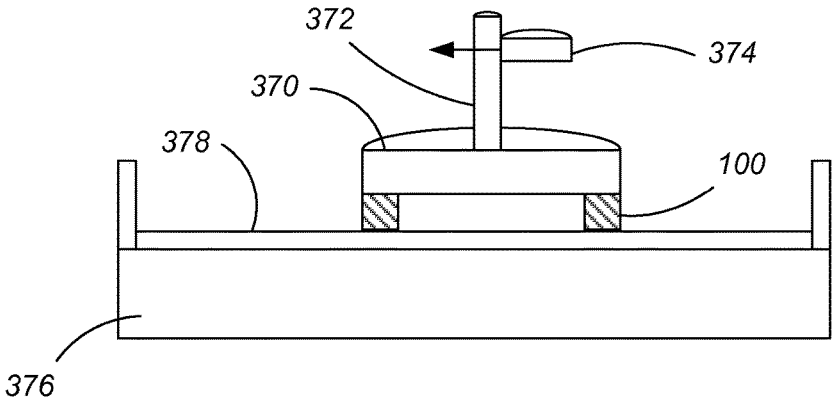

Referring to FIG. 25, as still another implementation, the retaining ring carrier 370 can be connected to a rotatable drive shaft 372, and a lateral force can be applied to the shaft 372 by the drive mechanism 374, such as rotating gears or wheels, while the retaining ring carrier 370 pushes the retaining ring 100 toward the platen 376 and polishing or lapping pad 378. The drive mechanism is 374 is located a distance away from the retaining ring carrier 370, so that the lateral force creates a moment that would tend to cause the retaining ring carrier 370 and retaining ring 100 to tilt. Consequently, the pressure from the polishing or lapping pad 378 on the outer edge of the retaining ring 100 will be increased, causing the outer edge of the retaining ring to wear at a faster rate and thus inducing a taper on the bottom surface of the ring.

The platen can be configured to rotate, orbit, vibrate, oscillate, or undergo random motion relative to the carrier head. In addition, the carrier head can undergo a fixed rotation, or it can be free to rotate under the applied lateral force from the lapping pad.

Figure 26:
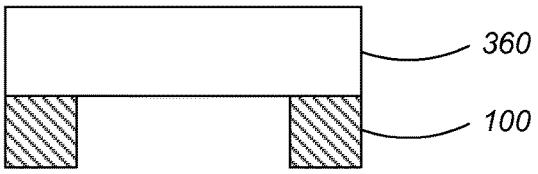
FIGS. 26 and 27 show a schematic of a retaining ring and retaining ring holder.
Figure 27:
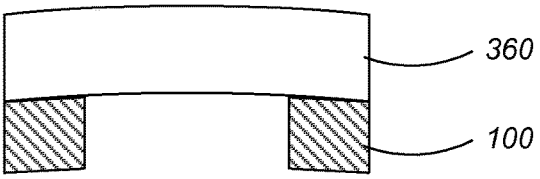

Referring to FIG. 26, in still another implementation, a retaining ring carrier 360 and the retaining ring 100 are formed of materials with different coefficients of thermal expansion. In this implementation, the retaining ring 100 is securely mounted to the carrier 360 while both are at a first temperature, and then the assembly of ring and carrier are heated or cooled to a different temperature. Due to the difference in the coefficients of thermal expansion, the retaining ring becomes slightly "crimped". For example, assuming that the carrier has a higher coefficient of thermal expansion than the retaining ring, then if the assembly is heated, the carrier will expand more than the ring. Consequently, as shown in FIG. 27, the carrier 360 will tend to bend outwardly, thereby drawing the inner edge of the retaining ring upwardly. Consequently, during machining of the retaining ring, more pressure will be applied to the outer edge of the retaining ring, and thus induce a taper.

In yet another implementation, the carrier 360 and the retaining ring 100 can be formed of materials with similar coefficients of thermal expansion, but the carrier 360 and retaining ring 100 can be heated to different temperatures. For example, the retaining ring holder could be brought to a temperature above that of the retaining ring. Consequently, the retaining ring holder will expand, causing the holder to bend outwardly as shown in FIG. 27.

In addition to breaking in of the retaining ring as described above, the lapping apparatus can be used to lap the top surface of the retaining ring and/or the bottom surface of the carrier head. For this operation, the polishing pad is replaced by a metal lapping plate. The metal lapping plate can itself be lapped to defined flatness and can be electroplated to resist the corrosive effects of the slurry. Alternatively, the top of the table could be electroplated and used for lapping of the top surface of the retaining ring and/or the bottom surface of the carrier head. The lapping process can use the same motion as the break-in process, e.g., random vibration or elliptical motion.

After the retaining rings have been lapped by lapping apparatus to form a shaped profile on the bottom surfaces of the rings, the retaining rings can be removed from the lapping apparatus and secured to a CMP machine to be used in polishing wafers (e.g., silicon integrated-circuit wafers). Retaining rings can be lapped at a manufacturing facility and then shipped to a semiconductor fab to be used. Retaining rings can be lapped using a machine that is dedicated to lapping retaining rings. The lapping machine can be used primarily to lap retaining rings, and silicon substrates typically will not be polished using the lapping machine, though silicon substrates can be used as dummy substrates.

In review, a retaining ring can be formed by removing material from a bottom surface of an annular retaining ring to provide a target surface characteristic. The removal can be performed using a first machine dedicated for use in removing material from a bottom surface of retaining rings, and the target surface characteristic can substantially match an equilibrium surface characteristic that would result from breaking-in the retaining ring on a second machine used for polishing of device substrates. Thus, a retaining ring that has not been use in device substrate polishing can have a generally annular body having a top surface, an inner diameter surface, an outer diameter surface and a bottom surface, and the bottom surface can have a target surface characteristic that substantially matches an equilibrium surface characteristic that would result from breaking-in the retaining ring with the device substrate polishing.

A number of embodiments of the invention have been described, but other implementations are possible, and it will be understood that various modifications may be made without departing from the spirit and scope of the invention. Accordingly, other embodiments are within the scope of the following claims.

For example, various sections of the inner or outer surfaces 150, 230, 165 and 235 can have straight, sloped, or mixed straight and sloped geometry. Various other features, such as ledges or flanges, can be present on the upper surface 115 to permit the retaining ring to mate to the carrier head. The holes for screws or screw sheaths can be formed on the flange portion.

As another example, the retaining ring 100 can be constructed from a single piece of plastic, using, for example, PPS, instead of being formed from a separate upper portion 105 and lower portions 130.

Although various positional descriptors, such as "top" and "bottom" are used, these terms are to be understood as relative to the polishing surface, as the retaining ring can be used in polishing systems in which the substrate is face up, face down, or in which the polishing surface is vertical.

The present invention has been described in terms of a number of embodiments. The invention, however, is not limited to the embodiments depicted and described. Rather, the scope of the invention is defined by the appended claims.

A number of embodiments of the invention have been described. Nevertheless, it will be understood that various modifications may be made without departing from the spirit and scope of the invention. For example, elements and components described with one system or retaining ring can be used in conjunction with another system or retaining ring. Accordingly, other embodiments are within the scope of the following claims.

What is claimed is:

1. A method of forming a retaining ring, comprising:

forming a retaining ring with an inner diameter surface, an outer diameter surface, a top surface and a bottom surface; and lapping the bottom surface to provide a predetermined non-planar profile having a convex shape along a radial cross section of the retaining ring with a difference in height across the bottom surface between 0.001 mm and 0.05 mm, wherein the lapping is performed without a substrate positioned within the retaining ring.

2. The method of claim 1, wherein lapping the bottom surface includes applying a pressure differential across a width of the retaining ring.

3. The method of claim 2, wherein applying the pressure differential includes applying the pressure differential to the top surface of the retaining ring.

4. The method of claim 3, wherein lapping the bottom surface includes holding the retaining ring in a cover having a sloped lower surface that contacts the top surface of the retaining ring.

5. The method of claim 4, wherein the sloped lower surface is sloped upwardly from inside outward.

6. The method of claim 3, wherein lapping the bottom surface includes holding the retaining ring in a flexible holder.

7. The method of claim 6, wherein applying the pressure differential includes applying a downward pressure to a center of the holder.

8. The method of claim 7, wherein applying the downward pressure to the center of the holder causes the center of the holder to bow toward the platen so as to apply increased pressure to an inner edge of the retaining ring.

9. The method of claim 3, wherein lapping the bottom surface includes holding the retaining ring in a rigid holder.

10. The method of claim 9, wherein applying the pressure differential includes applying a lateral force to a shaft extending upwardly from the holder.

11. The method of claim 10, wherein applying the lateral force causes a moment of the holder so as to apply increased pressure to an outer edge of the retaining ring.

12. The method of claim 2, wherein applying the pressure differential includes applying the pressure differential to the bottom surface of the retaining ring.

13. The method of claim 1, wherein applying the pressure differential includes pressing the retaining ring against a concave lapping surface.

* * * * *